United States Patent [19]

Brewer

[11] Patent Number: 4,968,226

[45] Date of Patent: Nov. 6, 1990

[54] SUBMERGIBLE RECIPROCATING PUMP WITH PERFORATED BARREL

[76] Inventor: Carroll L. Brewer, 416 NW. 38th St., Oklahoma City, Okla. 73118

[21] Appl. No.: 345,095

[22] Filed: Apr. 28, 1989

[51] Int. Cl.[5] ..... F04B 21/08

[52] U.S. Cl. ..... 417/435; 417/554

[58] Field of Search ..... 417/435, 545, 547, 448–450, 417/550–554; 166/105.5

[56] References Cited

U.S. PATENT DOCUMENTS

| | | | |
|---|---|---|---|
| 719,004 | 1/1903 | Hoffman . | |
| 1,655,817 | 5/1927 | Marsh | 166/105.5 |
| 2,363,343 | 11/1944 | Lindgren . | |
| 2,905,099 | 9/1959 | Turner | 417/448 |
| 3,594,103 | 7/1971 | Hillis | 417/435 |
| 3,861,471 | 1/1975 | Douglas | 166/314 |
| 3,968,360 | 6/1976 | Greene | 417/53 |
| 4,557,668 | 12/1985 | Jones | 417/259 |
| 4,643,258 | 2/1987 | Kime | 166/369 |
| 4,662,831 | 5/1987 | Bennett | 417/430 |
| 4,673,338 | 6/1987 | Jones | 417/435 |
| 4,781,547 | 11/1988 | Madden | 417/444 |

*Primary Examiner*—Michael Koczo
*Assistant Examiner*—John A. Savid, III

[57] ABSTRACT

The present invention is directed to the prevention of gas lock in submergible reciprocating insert pumps typically employed in oil and gas wells. A plurality of openings are formed in the midportion of the body of the pump barrel. These openings allow fluid from the tubing string to enter the intake chamber of the barrel during a portion of the upstroke permitting equilibration of the pressure differential therebetween. Commercially available pumps can be modified easily to provide a pump in accordance with this invention.

12 Claims, 4 Drawing Sheets

SUBMERGIBLE RECIPROCATING PUMP WITH PERFORATED BARREL

FIELD OF THE INVENTION

The present invention relates generally to pumping devices, and in particular to submergible reciprocating pumps.

SUMMARY OF THE INVENTION

The present invention comprises a pump for lifting a column of fluid in a conduit which connects a reservoir of the fluid with a receptacle above the reservoir. The pump comprises a barrel receivable in the conduit. The barrel has an external diameter which permits fluid to flow around the barrel in the conduit. The barrel has a bottom with an opening therein, a top with an opening therein, and a body therebetween which defines a cavity continuous with the openings in the top and the bottom of the barrel. The midportion of the barrel has at least one opening therein. A valve is included for permitting fluid to flow only in an upward direction through the barrel.

A plunger, which is sized for substantially fluid tight reciprocation relative to the barrel, is received in the barrel. The plunger has a length substantially less than the length of the barrel. The plunger has a top with an opening therein, a bottom with an opening therein, and a body portion therebetween. A cavity extends through the body portion of the plunger continuous with the openings in the top and the bottom of the plunger. The plunger has an end portion which with a portion of the barrel cavity defines a fluid intake chamber in the barrel. A valve is included for permitting fluid to flow only in an upward direction through the plunger.

A sucker rod or some similar device is included for reciprocating the barrel and the plunger between a collapsing stroke and extension stroke. The extension stroke is characterized by an intake phase and an equilibrating phase. In the intake phase, fluid communication between the conduit and the fluid intake chamber is prevented and fluid from the reservoir is sucked into the fluid intake chamber. During the equilibration phase, the fluid communication between the conduit and the intake chamber through the openings in the midportion of the body of the barrel is permitted .

The present invention further comprises a pump for lifting fluid through a conduit which connects a reservoir of the fluid with a receptacle above the reservoir. The pump comprises a barrel receivable in the conduit. The barrel has a bottom with an opening therein, a top with an opening therein, and a body having a midportion therebetween. The barrel has a diameter which permits fluid in the conduit to flow around the barrel. The body of the barrel defines a cavity continuous with the openings in the top and bottom of the barrel. At least one opening is provided in the midportion of the barrel body. A valve is included in the barrel for permitting fluid to flow only in an upward direction through the barrel.

A plunger, sized for substantially fluid tight reciprocation relative to the barrel, is received in the barrel. The plunger has a top with an opening therein and a bottom with an opening therein, and a body. The body defines a cavity continuous with the openings in the top and bottom of the plunger. The length of the plunger is substantially less than the length of the barrel. The plunger has an end portion which, with a portion of the barrel cavity, defines a fluid intake chamber. The volume of the fluid intake chamber therefore varies with reciprocal movement of the plunger and the barrel. A valve associated with the plunger is included for permitting fluid to flow through the plunger only in an upward direction.

A sucker rod or some like device is provided for reciprocating the plunger and barrel between an extension stroke and a collapsing stroke. In the extension stroke, the volume of the fluid intake chamber increases. In the collapsing stroke, the volume of the fluid intake chamber decreases. The openings in the midportion of the barrel cooperate with the relative lengths of the barrel and the plunger to prevent fluid communication between the conduit and the fluid intake chamber during a first phase of the extension stroke and to permit communication between the conduit and the fluid intake chamber during a second phase of the extension stroke.

BRIEF DESCRIPTION OF THE DRAWINGS

FIG. 6 is a semi-schematic view of the pump in FIG. 2 showing the pump in the fully extended position, at the top of the barrel between the upstroke and the downstroke.

DETAILED DESCRIPTION OF THE PREFERRED EMBODIMENT

The phenomenon known as "gas lock" has been a persistent problem in down hole pumping operations. A gas locked pump results in greatly reduced producitivity, and in some cases completely incapacitates the pump. To restore productivity, the pump must be replaced. However, because gas lock is a result of the nature of the fluid being recovered, the replacement pump likewise is likely to become inoperative. The present invention comprises a down hole pump which eliminates gas lock and greatly improves pumping efficiency.

Figure 1:
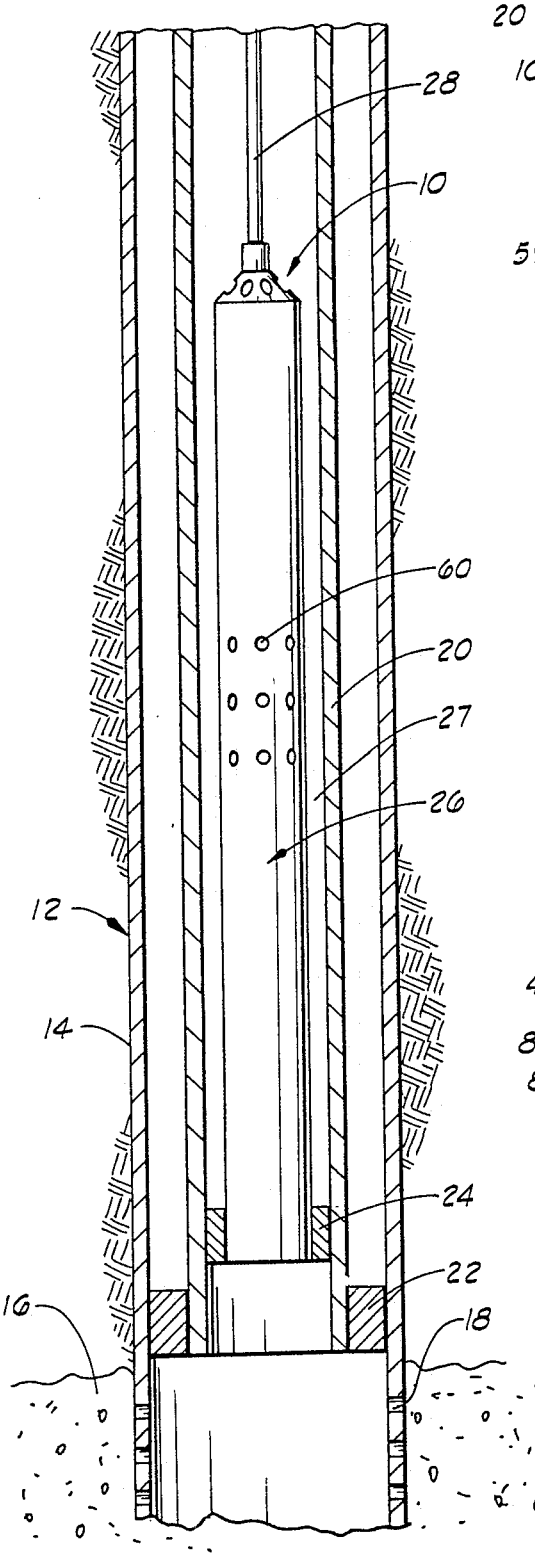
FIG. 1 is a partial sectional view showing a pump constructed in accordance with the present invention mounted in the tubing string of an oil well. In this embodiment, the pump has a stationary barrel and a traveling plunger.

Turning now to the drawings in general and to FIG. 1 in particular, there is shown therein a pump designated generally by the reference numeral 10 constructed in accordance with the present invention. The pump 10 is shown installed in an oil well. As used herein, the term "oil well" denotes any well from which petroleum products of any sort may be recovered.

The well 12 comprises a length of well casing 14 extending from the surface (not shown) into a geological formation 16. The fluid, which typically includes a varying mixture of crude oil, water and gases, enters the casing 14 through holes 18 in the casing at about the level of the formation.

A conduit, such as a tubing string 20, is secured in the casing 14 so that the lower end of the tubing string is about the level of the formation 16, or just slightly above the formation. The upper end (not shown) of the tubing string 20 extends above the surface and conducts fluid from the formation to a receptacle and associated recovery equipment of known construction at the well head (not shown).

In the embodiment shown, a packer 22 is used to secure the tubing string 20 in the casing 14. Packers often are used in the event of a casing leak to isolate the reservoir from the casing leak fluid. However, it should be understood that the present invention may be used whether or not packers are used. Rather, the depiction of the packer 22 in the figure is merely to illustrate the well condition most conductive to gas lock, as described in more detail below.

The pump 10 is secured in the tubing string 20 by a seating assembly 24 near the bottom of the pump 10. The pump 10 comprises a barrel 26 having an external diameter less than the internal diameter of the tubing string 20 and which permits fluid in the tubing string 20 to flow around the barrel 26 in the space 27. The space 27 is continuous with the lumen 25 of the tubing string 20 above the pump 10. Inside of the barrel is a plunger (not shown in FIG. 1) which is reciprocated by a rod 28 which is operated by a mechanism mounted near the well head.

A pump having this general construction is known commonly as a "bottom hold down" insert type pump. A variety of such pumps are commercially available. These pumps may comprise a stationary barrel with a traveling plunger (FIGS. 1–8) or may comprise a stationary plunger with a traveling barrel (FIGS. 9–11), the latter to be described in more detail hereafter.

Figure 2:
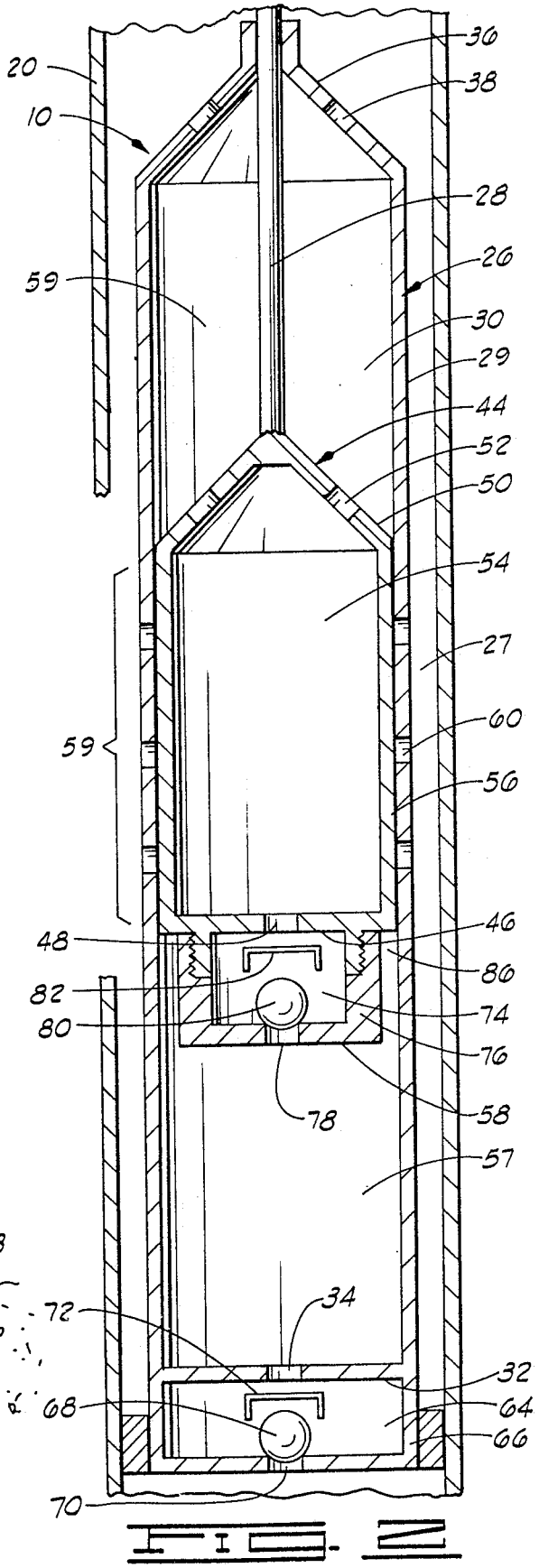
FIG. 2 is an enlarged sectional view of the pump shown in FIG. 1.

The internal workings of the pump 10 are best shown in FIG. 2. The barrel 26 comprises a body 29 which defines a cavity 30. The barrel has a bottom 32 with an opening 34 through which fluid from the formation 16 (FIG. 1) may enter the pump. The barrel has a top 36 with openings 38 therein through which fluid exits the pump into the tubing string 20.

The plunger 44, which is suspended on the sucker rod 28, is received in the cavity 30 defined by the body 29 of the barrel. The plunger 44 is sized for substantially fluid tight reciprocation relative to the barrel 26. The plunger 44 has a bottom 46 with openings 48 therein and a top 50 with openings 52 therein. A cavity 54, continuous with the openings 48 and 52, is provided in the body 56 of the plunger 44 so that fluid can flow through the plunger.

The length of the plunger 44 is substantially less than the length of the barrel 26, so that it can travel a distance inside the barrel. Thus, the plunger divides the barrel cavity 30 into a lower chamber 57 beneath the plunger, defined in part by the end portion 58 of the plunger and which serves in this embodiment as the fluid intake chamber, and an upper chamber 59 above the plunger. The end 58 preferably is defined by a valve cage, to be described.

The midportion 59 of the barrel body 29 is perforated. As used herein, the "midportion" refers generally to the middle third of the barrel body. To this end, an aperture such as a plurality of openings, designated collectively herein by the reference numeral 60, is provided in the midportion 59 of the barrel 26, for providing fluid communication between the tubing string 20 and the intake chamber 57. Neither the number nor the size of the openings 60 is critical to the operation of the present invention. As shown, there may be three rows of openings spaced circumferentially about the barrel. Alternately, a string of openings may be arranged in a helical fasion about the midportion. A suitable size for the openings 60 is about 0.2 inch in diameter, and preferably the openings will range in number between 1 and 35. However, the pattern, number, size and shape of the openings may vary widely.

These openings 60 should be placed generally midway between the top 36 and the bottom 32 of the barrel body 29, and further should cooperate with the relative lengths of the plunger and the barrel as set forth above. For example, in a barrel which is about 12 feet long, the openings may be dispersed within the middle one inch to the middle two feet of the barrel.

With continuing reference to FIG. 2, a first one-way check valve 64 is positioned at the bottom 32 of the barrel 26, for permitting fluid to flow through the barrel only in an upward direction. In this embodiment, the valve 64 is a stationary valve. This valve may be any of several conventional types, one of which is a ball valve. Such a valve is shown semi-schematically in the drawings, and generally comprises a cage 66 which contains a ball 68. In the open position, fluid can enter the cage 66 through the opening 70. In the closed position, the ball 68, seated in the opening 70, prevents backflow. Obstruction of the opening 34 in the barrel bottom 32 is prevented by a stop 72 of some sort.

A second one-way check valve 74 is positioned at the bottom 46 of the plunger 44. Because it moves with the plunger, this valve is referred to as the traveling valve in this embodiment. This valve also may be of any suitable type, but preferably is a ball valve, like the stationary valve described previously. Thus, the valve 74 preferably comprises a cage 76 which preferably has a diameter less than the plunger body 56, for a purpose to be described. The cage 76 has an opening 78 and ball 80 therein. The ball 80 is restrained from obstructing the opening 48 in the plunger bottom 46 by a stop 82.

Most preferably, the end portion 58 of the plunger 44 has an outer diameter less than the diameter of the plunger body 56. This creates an annular space 86 around the end portion in which fluid can flow. Now it will be appreciated that this feature is provided conveniently by the valve cage component, previously described, which serves as the end portion 58.

Figures 3, 4, 5:
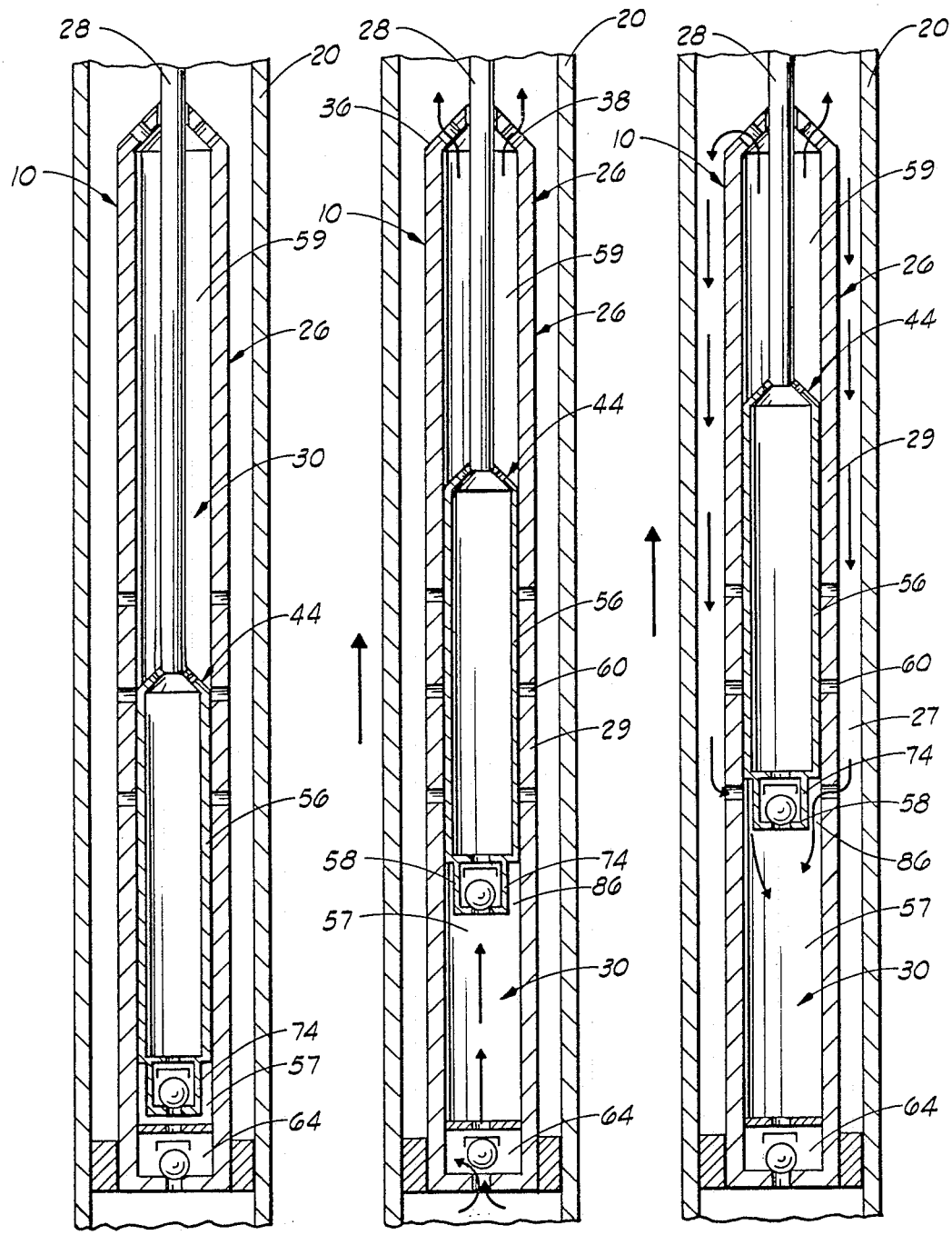
FIG. 3 is a semi-schematic view of the pump shown in FIG. 2 showing the pump in the collapsed position, between the downstroke (collapsing stroke) and the upstroke (extension).
FIG. 4 is a semi-schematic view of the pump shown in FIG. 2 showing the plunger in the first phase of the upstroke.
FIG. 5 is a semi-schematic view of the pump shown in FIG. 2 showing the plunger in the second phase of the upstroke.

The operation of the pump is best illustrated with reference to FIGS. 3–8, which illustrate schematically the pumping cycle. FIG. 3 depicts the pump 10 with the plunger 44 at the beginning of the upstroke of the plunger or extension stroke. The hydrostatic pressure of the fluid column in the tubing strike 20 and gravity at this point keeps both the traveling valve 74 and the stationary valve 64 closed.

Referring now to FIG. 4, the plunger 44 is pulled upward by the sucker rod 28. With the upward movement of the plunger 44 and the concomitant increase in hydrostatic pressure in the column of fluid above the pump 10, the traveling valve 74 remains closed. However, as the plunger rises, the pressure in the lower (intake) chamber 57 drops, and may create a vacuum therein. As shown, during this first phase of the extension stroke, referred to herein as the intake phase, the plunger body 56 obstructs the openings 60 in the barrel body 29. Thus, fluid from below the pump is sucked through the now open stationary valve 64.

As the plunger 44 is lifted, fluid above the closed traveling valve 74 is lifted and fluid above the plunger in the upper chamber 59 is pushed up into the tubing string 20 through the openings 38 in the top 36 of the barrel 26. This, in turn, pushes the column of fluid in the tubing string 12 upwardly for eventual recovery at the surface.

It is during this intake phase of the upstroke of the plunger, or the extension stroke, that agases dispersed in the fluid mixture entering the pump tend to separate into a layer above the liquid as a result of the rapid decrease in pressure on the fluid. When the volume of gas in the intake chamber 57 is large enough, there is not enough pressure created by the descending plunger 44 to overcome the hydrostatic pressure above the traveling valve 74 and the traveling valve 74 does not open.

During the upstroke of the plunger 44 the gaseous layer expands. This prevents the pressure in the intake chamber from being reduced enough to permit fluid to enter the intake chamber 57 through the stationary valve 64. At this point, reciprocation of the plunger 44 in the barrel 26 merely compresses and decompresses the gaseous layer and displaces no fluid. This condition in a well, which renders the pump useless, is referred to as "gas lock".

Because of the openings 60 in the barrel body 29 in the present pump 10, gas lock does not occur. While not wishing to be bound by theory, it is believed that this result is obtained because of the gradual equalization of pressure between the intake chamber 57 in the barrel 26 and the conduit 20 (tubing string), such equalization being permitted by the openings 60 in the barrel body 29 as the lower end 58 of the plunger exposes the openings to the intake chamber.

Specifically, as depicted in FIG. 5, as the lower end 58 of the plunger 44 rises above the lowest of the openings 60, the pressure in the tubing string 20 forces fluid in the space 27 around the barrel body 29 to enter the lower (intake) chamber 57 through the openings 60. With this, pressure between the tubing string begins to equalize with the pressure in the lower chamber, and the stationary valve 64 closes.

Now the effect of theh reduced diameter of the lower end 58 of the plunger 44 may be understood. Although fluid flow is permitted into the lower chamber, the lower end 58 dampens this flow. As the plunger continues to rise, exposing more of the openings, this dampening effect results in a smoother equalization process. As the plunger 44 nears the upper limit of its travel in the barrel 26, the pressure differential between the lower (intake) chamber 57 and the tubing string 20 decreases.

Finally, the plunger 44 reaches the top of its stroke, as shown in FIG. 6. At this point, pressures have equalized between both chambers in the barrel cavity 30 and the tubing string 20.

Next, the downstroke of the plunger, referred to herein also as the collapsing stroke of the pump, begins. At the beginning of the downstroke, the openings 60 in the barrel 29 are unobstructed by the plunger and pressures are equal. The pressure exerted by the descending plunger 44 may result in the escape of free gases, if any, from the lower chamber 57 through the openings 60 into the space 27 in the tubing string 20.

Figures 5, 7, 8:
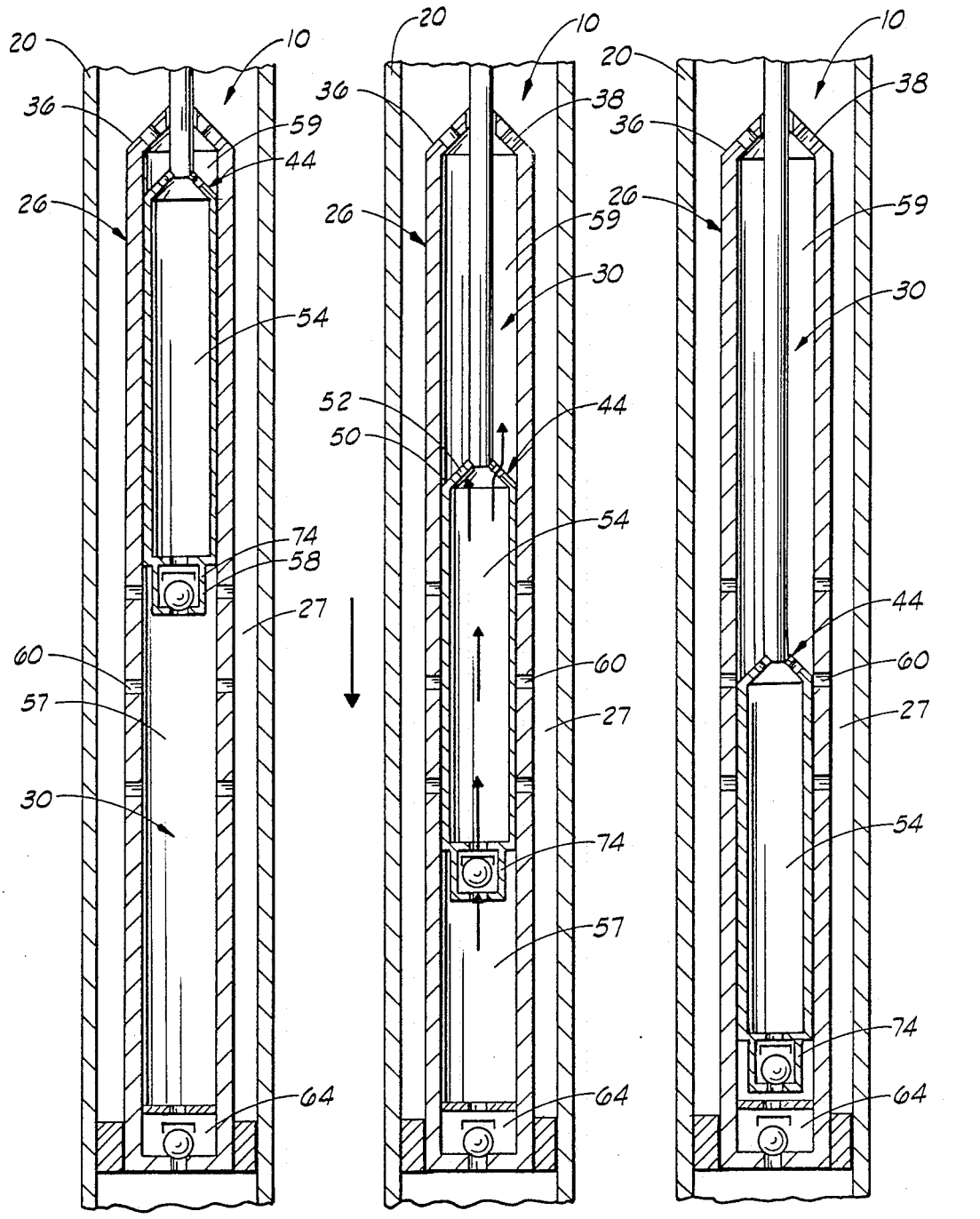
FIG. 7 is a semi-schematic view of the pump in FIG. 2 showing the plunger midway through the downstroke.
FIG. 8 is a semi-schematic view of the pump in FIG. 2 showing the plunger at the bottom of the downstroke.

During the descent of the plunger 44 all fluids within the lower chamber 57, since pressures both above and below the traveling valve 74 are essentially equal, may also be displaced through the traveling valve 74, the plunger cavity 54, the openings 52 in the top 50 of the plunger and the upper chamber 59 in the pump barrel 26, as shown in FIG. 7. Thus, on the next upstroke of the plunger, this fluid will be pushed out the openings 38 in the top 36 of the barrell to become part of the column of fluid being lifted in the tubing string.

Finally, and with reference now to FIG. 8, the plunger 44 reaches the bottom of the downstroke of the plunger (collapsing stroke), and displacement of fluid in the plunger is completed. The pump now is in position for the next upstroke (extension stroke), and the cycle begins again.

Figures 9, 10, 11:
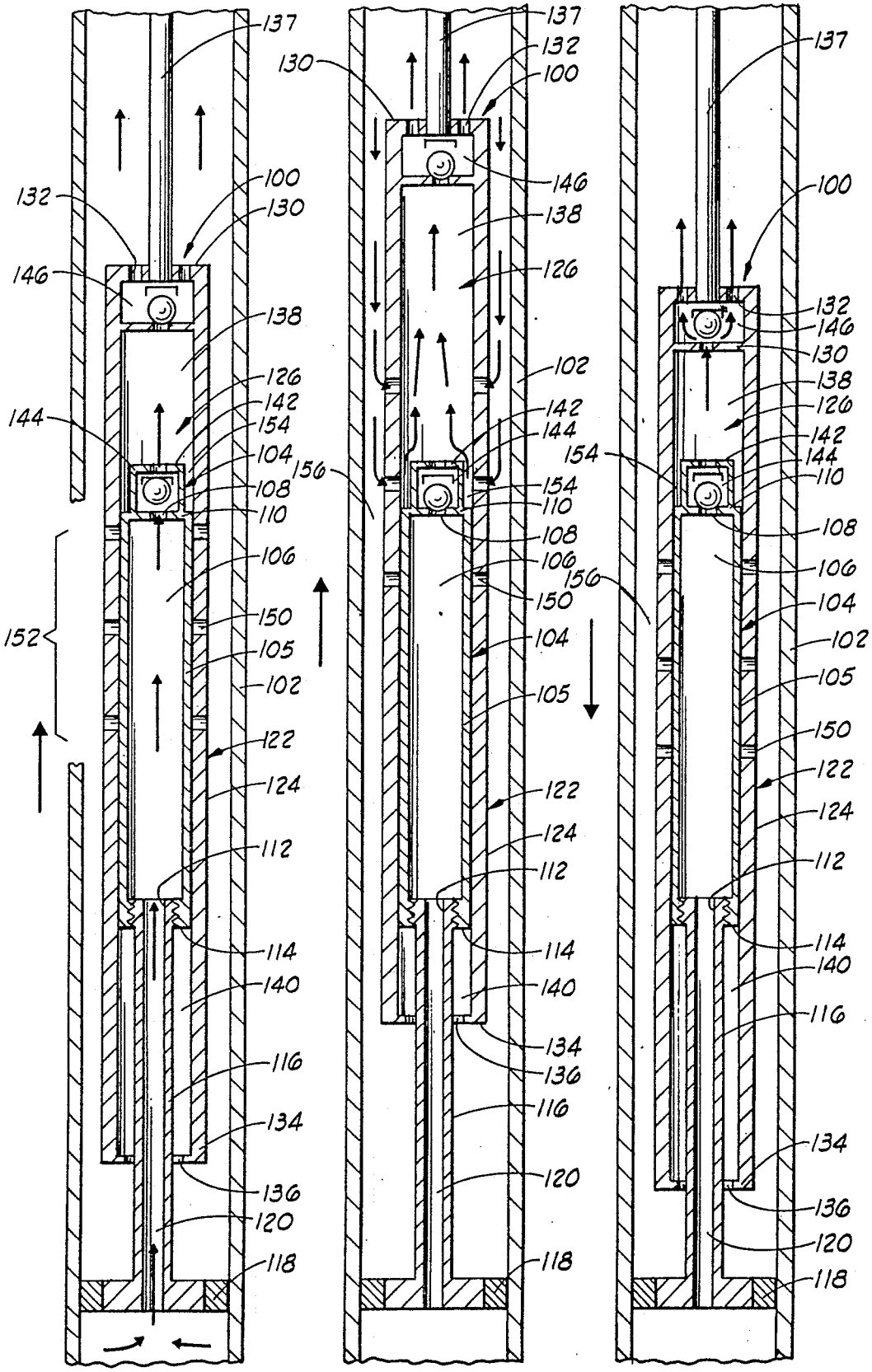
FIG. 9 is a semi-schematic view of another embodiment of the pump of the present invention comprising a stationary plunger and a traveling barrel. In this Figure, the barrel is shown in the first or intake phase of the upstroke of the barrel (extension).
FIG. 10 is a semi-schematic view of the pump of FIG. 9 showing the barrel further up on the plunger in the second phase of the upstroke of the barrel.
FIG. 11 is a semi-schematic view of the pump of FIG. 9 showing the barrel nearing the bottom of the downstroke of the barrel (collapsing phase).

Turning now to FIG. 9, illustrated schematically therein and designated generally by the reference numberal 100 is another embodiment of the pump of the present invention. This embodiment is functionally equivalent to the previously described embodiment, but differs structurally in that in this embodiment the plunger is stationary and the barrel is reciprocated over it. A pump of this construction is disposed likewise within a conduit, such as the tubing string 102.

The pump 100 comprises a stationary plunger 104 with a body 105 defining a cavity 106 therethrough, continuous with an opening 108 in the top 110 and an opening 112 in the bottom 114 in the plunger. The plunger 104 is mounted on a stem 116 which is secured in the conduit or tubing string 102 by a seating nipple 118 or some like device. A bore 120 extends through the stem 116 to provide fluid communication between the plunger cavity 106, the tubing string 102 and the reservoir (not shown) below the pump. The plunger 104 is received within a barrel 122 having a body 124, the inside of which defines a cavity 126. The top 130 of the barrel 122 has openings 132 and the bottom 134 of the barrel has an opening 136, which openings are continuous with the cavity 126. The external diameter of the barrel 122 is less than the internal diameter of the tubing string 102, and the space 133 therebetween is continuous with the lumen 135 of the tubing string 102 above the pump 100.

The length of the plunger 104 is substantially less than the length of the barrel 122 so that the barrel may be reciprocated over the plunger 104 by means of a sucker rod 137, or the like. Thus, the barrel cavity 126 is divided by the plunger 104 into an upper chamber 138 above the plunger and a lower chamber 140 below the plunger. As will become apparent, in this embodiment the upper chamber 138 in the traveling barrel 122 serves as the fluid intake chamber, and is in part defined by the end portion 142 of the plunger.

Valves are included for permitting the fluid to flow only in an upward direction through the pump 100. Thus, as the plunger 104 and barrel 122 are reciprocated, fluid is sucked into the pump from the reservoir (not shown) and lifted up the tubing string 102. Preferably, the valves include a stationary valve 144 associated with the plunger, such as a fluid check valve of the ball and seat variety, at the upper end 142 of the plunger 104, and a similar traveling valve 146 associated with the barrel 122, preferably mounted at the top 130 of the barrel. These valves may be of any suitable construction, one of which is described above in connection with the stationary barrel embodiment.

An aperture, preferably in the form of a plurality of openings designated collectively herein by the reference numberal 150 are provided in the midportion 152 of barrel body 124. The openings 150 are positioned so that during a first phase of the extension stroke of the pump (upstroke of the traveling barrel), the openings are blocked by the plunger body 105 preventing fluid communication between the tubing string 102 and the upper (intake) chamber 138 of the barrel. During a second phase of the extension stroke, the openings 150 are open and fluid communication between the intake chamber 138 and the tubing string 102 is permitted.

In the preferred construction of this embodiment, the upper end 142 of the plunger 104 which extends into the upper (intake) chamber 138 has a reduced diameter, that is, it has a diameter significantly less than the external diameter of the plunger body 105 for creating a space 154, for the purpose described above in connection with the starionary barrel embodiment. As described above, the reduced diameter may be provided by selecting an appropriate valve cage component.

Again, while not wishing to be bound by theory, it is believed that a traveling barrel pump constructed in accordance with the present invention operates as depicted in FIGS. 9–11. In FIG. 9, the barrel 122 is shown during the barrel's upstroke, that is, the extension stroke of the pump. As the barrel rises, due to the traveling valve being closed by hydrostatic pressure and gravity, the pressure in the upper chamber 138 drops and the stationary valve 144 opens. Fluid from the plunger cavity 106 is sucked through the valve 144 and into the upper (intake) chamber 138. At the same time, fluid from below the pump 100 is pulled through the bore 120 into the plunger cavity 106. Simultaneously, the rising barrel 122 lifts the column of fluid in the tubing string 102 above the barrel to the receptacle (not shown) at the surface. During this intake phase of the extension stroke, the openings 150 in the barrel body 124 are blocked.

As shown in FIG. 10, as the barrel 122 continues to rise, uppermost level of openings 150 are exposed and fluid from the space 133 in the tubing string 102 enters the upper (intake) chamber 138 of the barrel closing the stationary valve 144. As the barrel 122 continues to rise, the pressure in the tubing string 102 and the pressure in the upper (intake) chamber 138 equalizes.

The downstroke of the barrel, or the collapsing stroke of the pump, is shown in FIG. 11. As the barrel 122 descends, the stationary valve 144 remains closed. This forces the fluid in the upper (intake) chamber 138 through the open traveling valve 146 and out through the openings 132 into the tubing string above the pump. On the next upstroke of the barrel 122, this fluid will be lifted.

EXAMPLE

The efficiency of a pump constructed in accordance with the present invention is demonstrated by the following example. A production facility to which five producing wells contribute was selected. One of the wells, referred to herein as Well No. 5, had ceased producing as a result of a casing leak and had been shut down. A packer was installed in the well to isolate the reservoir from the casing leak fluid. A new pump, including an assembly bearing U.S. Pat. No. 4,219,311, was installed in the well to attempt production. Shortly after this pump was installed the valve seat mechanism failed, it became gas locked and Well No. 5 would not produce.

A new conventional bottom hold down, insert pump with a stationary barrel about 12 feet long was purchased. Prior to installation in Well No. 5, it was modified in accordance with the present invention by drilling 32 perforations in the barrel. Specifically, a first pair of holes about 0.125 inches in diameter were drilled opposite each other in the barrel about 45 inches from the bottom. A second pair of holes about 0.216 inches in diameter were drilled, also in an opposing pattern, about 46 inches from the bottom of the barrel and rotated on the barrel about 90 degrees. A third pair of opposing holes, also about 0.216 inches in diameter, were drilled about 47 inches from the body and rotated another 90 degrees from the position of the second pair. Then 26 holes about 0.216 inches in diameter were drilled in a spiral pattern, at 90 degree increments, beginning at 48 inches above the bottom of the barrel up to about 73 inches from the bottom of the barrel. Thus, a total of 32 holes were placed in the barrel over 28 inches roughly in the middle of the barrel.

Table 1 displays the production pattern of the four producing wells in the facility for the nine and one-half month period prior to installation of the modified pump of the present invention.

TABLE 1

| Period | Average Production for the Period in Barrels Oil per Day (BOPD) |
|---|---|
| 1 (28 days) | 11.38 |
| 2 (31 days) | 10.26 |
| 3 (30 days) | 10.10 |
| 4 (30 days) | 10.68 |
| 5 (30 days) | 8.53 |
| 6 (31 days) | 9.68 |
| 7 (31 days) | 9.35 |
| 8 (24 days) | 12.58 |
| 9 (31 days) | 12.84 |
| 10 (14 days) | 10.44 |
| Average BOPD | 10.03 |

On the 15th day of the tenth month, the modified pump was installed in Well No. 5. All other variables remained stable. The improved production of the entire facility, including Well No. 5, for the next three and one-half month period is shown in Table 2.

TABLE 2

| Period | Average Monthly Production in Barrels Oil per Day (BOPD) |
|---|---|
| 10 (15 days) | 16.76 |
| 11 (29 days) | 16.48 |
| 12 (31 days) | 16.81 |
| 13 (22 days) | 17.57 |
| Average BOPD | 16.87 |

The results depicted in Tables 1 and 2 demonstrate the marked increase in production resulting from the substitution of the modified pump in Well No. 5. After installation of the modified pump, the total oil production of the facility increased by an average of 6.84 BOPD. Total fluid produced from Well No. 5 could not be measured, due to lack of adequate testing facilities.

Periodic samples of the recovered fluid from Well No. 5 demonstrated that the oil content of the fluid from Well No. 5, after installation of the modified pump, was about 12.5%. Given the above figure of 6.84 barrels of oil per day, the total fluid production from Well No. 5 can be calculated at about 54.72 barrels per day (BPD), (6.84 BOPD and 47.88 BWPD). Gas volume was not measured, but was observed to be about 2,000 to 3,000 CFD from Well No. 5.

Well No. 5 was operated at a rate of seven strokes per minute and had a 56 inch surface stroke length. Calculated pump capacity at 100% efficiency is 76.7 BPD. Allowing no consideration for the volume of gas being passed through the pump, at 54.72 BPD the efficiency of modified pump in Well No. 5 was calculated to be 71.3%.

Now it will be appreciated that the present invention may be applied with equal success to stationary barrel type pumps and traveling barrel type pumps. Another advantage of a pump constructed in accordance with this invention is that it may be employed regardless of the presence of packers in the well casing.

Still further, the present invention may be practiced by machining the perforations in the midportion of the barrel at the time the pump is manufactured or at any time during the life of the pump. Accordingly, the efficiency of a pump can be increased markedly without any significant increase in production costs.

Finally, while the present invention has been described in the context of an oil well, the invention is not so limited. A pump constructed in accordance with the present invention may be used in any pumping operation in which fluid from a reservoir is to be lifted in a tubular conduit to a receptacle above the reservoir and in which a phenomenon like gas lock is likely to be experienced.

Changes may be made in the combination and arrangement of the various parts, elements, steps and procedures described herein without departing from the spirit and scope of the invention as defined in the following claims.

What is claimed is:

1. A pump for lifting fluid through a conduit which connects a reservoir of the fluid with a receptacle above the reservoir, the pump comprising:

a barrel receivable in the conduit, the barrel having an external diameter less than the internal diameter of the conduit creating a space therebetween which is continuous with the lumen of the conduit above the pump, the barrel having a bottom with an opening therein, a top with an opening therein and a body which is imperforate except for aperture means in the midportion thereof, the body defining a cavity continuous with the openings in the top and bottom of the barrel;

a plunger received in the barrel and sized for substantially fluid tight reciprocation relative to the barrel, the plunger having a length substantially less than the barrel, the plunger comprising a bottom with an opening therein and a top with an opening therein, the bottom and the top connected by a body portion through which a cavity extends continuous with the openings in the bottom and top of the plunger, and the plunger having an end portion which with a portion of the barrel cavity defines a fluid intake chamber;

a valve associated with the plunger for permitting fluid to flow only in an upward direction through the plunger;

a valve associated with the barrel for permitting fluid to flow only in an upward direction through the barrel; and means for reciprocating the barrel and plunger between a collapsing stroke and an extension stroke, wherein the extension stroke is characterized by an intake phase, during which fluid communication between the conduit and the fluid intake chamber is prevented, and a pressure equalization phase, during which fluid communication between the conduit and the fluid intake chamber through the openings in the midportion of the barrel body is permitted.

2. The pump of claim 1 wherein there are a plurality of openings in the midportion of the barrel.

3. The pump of claim 1 wherein the end portion of the plunger which forms a part of the fluid intake chamber has a diameter less than the diameter of the body of the plunger creating an annular space between the end portion of the plunger and the barrel sufficient to permit fluid to flow thereabout and between the conduit and the barrel through the openings in the midportion of the barrel body.

4. The pump of claim 1 wherein the conduit is the tubing string of an oil well.

5. The pump of claim 2 wherein the conduit is the tubing string of an oil well.

6. The pump of claim 1 in which the pump barrel remains stationary and the plunger is reciprocated.

7. The pump of claim 1 in which the plunger remains stationary and the pump barrel is reciprocated.

8. A pump for lifting fluid through a conduit which connects a reservoir of the fluid with a receptacle above the reservoir, the pump comprising:

a barrel receivable in the conduit, the barrel having an external diameter less than the internal diameter of the conduit creating a space therebetween which is continuous with the lumen of the conduit above the pump, the barrel having a bottom with an opening therein, a top with an opening therein, and a body having a midportion therebetween, the body defining a cavity therethrough continuous with the openings in the top and bottom of the barrel;

aperture means in the midportion of the barrel body, the barrel body being otherwise imperforate, for providing fluid communication between the conduit and the barrel cavity;

a plunger received in the barrel and being sized for fluid tight reciprocation relative to the barrel, the plunger having a top with an opening therein and a bottom with an opening therein, and a body defining a cavity therethrough continuous with the openings in the top and bottom of the plunger, wherein the length of the plunger is substantially less than the length of the barrel, and wherein the plunger has an end portion which with a portion of the barrel cavity defines a fluid intake chamber the volume of which varies with reciprocal movement of the plunger;

a valve associated with the plunger for permitting fluid to flow only in an upward direction through the plunger;

a valve associated with the barrel for permitting fluid to flow only in an upward direction through the barrel; and means for reciprocating the plunger and the barrel between an extension stroke, during which the volume of the fluid intake chamber increases, and a collapsing stroke, during which the volume of the fluid intake chamber decreases, wherein the position of the aperture means in the barrel body and the relative lengths of the barrel body and the plunger body cooperate to prevent fluid communication between the conduit and the fluid intake chamber during a first phase of the extension stroke of reciprocation and to permit fluid communication between the conduit and the fluid intake chamber during a second phase of the extension stroke.

9. The pump of claim 8 wherein the end portion of the plunger which in part defines the fluid intake chamber has a diameter less than the diameter of the plunger body.

10. The pump of claim 8 wherein the conduit is the tubing string of an oil well.

11. The pump of claim 8 wherein the plunger is stationary and the barrel is reciprocated.

12. The pump of claim 8 wherein the plunger is reciprocated and the barrel is stationary.

* * * * *

UNITED STATES PATENT AND TRADEMARK OFFICE

CERTIFICATE OF CORRECTION

PATENT NO. : 4,968,226

DATED : November 6, 1990

INVENTOR(S) : Carroll L. Brewer

It is certified that error appears in the above-identified patent and that said Letters Patent is hereby corrected as shown below:

In the drawings, sheet 1, Figure 1, the reference numeral 25 should be applied to the lumen of the tubing string 20 above the pump 10.

In the drawings, sheet 1, Figure 2, the reference numeral 25 should be applied to the lumen of the tubing string 20 above the pump 10.

In the drawings, sheet 2, Figure 3, the reference numeral 25 should be applied to the lumen of the tubing string 20 above the pump 10.

In the drawings, sheet 2, Figure 3, the reference numeral 27 should be applied to the lumen of the tubing string 20 around the barrel 26 of the pump 10.

In the drawings, sheet 2, Figure 4, the reference numeral 25 should be applied to the lumen of the tubing string 20 above the pump 10.

UNITED STATES PATENT AND TRADEMARK OFFICE

CERTIFICATE OF CORRECTION

PATENT NO. : 4,968,226

DATED : November 6, 1990

INVENTOR(S) : Carroll L. Brewer

It is certified that error appears in the above-identified patent and that said Letters Patent is hereby corrected as shown below:

In the drawings, sheet 2, Figure 4, the reference numeral 27 should be applied to the lumen of the tubing string 20 around the barrel 26 of the pump 10.

In the drawings, sheet 2, Figure 5, the reference numeral 25 should be applied to the lumen of the tubing string 20 above the pump 10.

In the drawings, sheet 3, Figure 6, the reference numeral 25 should be applied to the lumen of the tubing string 20 above the pump 10.

In the drawings, sheet 3, Figure 7, the reference numeral 25 should be applied to the lumen of the tubing string 20 above the pump 10.

In the drawings, sheet 3, Figure 8, the reference numeral 25 should be applied to the lumen of the tubing string 20 above the pump 10.

UNITED STATES PATENT AND TRADEMARK OFFICE

CERTIFICATE OF CORRECTION

PATENT NO. : 4,968,226

DATED : November 6, 1990

INVENTOR(S) : Carroll L. Brewer

It is certified that error appears in the above-identified patent and that said Letters Patent is hereby corrected as shown below:

Title page, item [56]:

In the Reference Cited, U.S. Patent No. 3,968,360 issued to Greene, please delete the "8" and substitute therefor --6--.

Col. 3, line 34, please delete the word "conductive" and substitute therefor the word --conducive--.

Col. 4, line 24, please delete the word "fasion" and substitute therefor the word --fashion--.

Col. 4., line 67, please delete the word "illustrated" and substitute therfor the word --understood--.

UNITED STATES PATENT AND TRADEMARK OFFICE

CERTIFICATE OF CORRECTION

PATENT NO. : 4,968,226

DATED : November 6, 1990

INVENTOR(S) : Carroll L. Brewer

It is certified that error appears in the above-identified patent and that said Letters Patent is hereby corrected as shown below:

Col. 5, line 27, please delete the word "agases" and substitute therefore the word --gases--.

Signed and Sealed this

Twentieth Day of October, 1992

*Attest:*

DOUGLAS B. COMER

*Attesting Officer*

*Acting Commissioner of Patents and Trademarks*